US006572757B2

(12) United States Patent
de Nora et al.

(10) Patent No.: US 6,572,757 B2
(45) Date of Patent: Jun. 3, 2003

(54) METHOD FOR PRODUCING ALUMINUM AND ELECTROLYTIC CELL WITH IMPROVED ALUMINA FEED DEVICE

(75) Inventors: Vittorio de Nora, Nassau (BS); Georges Berclaz, Veyras (CH)

(73) Assignee: Moltech Invent S.A. (LU)

( * ) Notice: Subject to any disclaimer, the term of this patent is extended or adjusted under 35 U.S.C. 154(b) by 13 days.

(21) Appl. No.: 09/978,161

(22) Filed: Oct. 16, 2001

(65) Prior Publication Data

US 2002/0066674 A1 Jun. 6, 2002

Related U.S. Application Data

(63) Continuation-in-part of application No. PCT/IB00/00477, filed on Apr. 17, 2000, and a continuation-in-part of application No. PCT/IB99/00697, filed on Apr. 16, 1999.

(51) Int. Cl.[7] ..... C25C 3/14
(52) U.S. Cl. ..... 205/392; 205/380; 204/245
(58) Field of Search ..... 205/372, 376, 205/380, 392; 204/245

(56) References Cited

U.S. PATENT DOCUMENTS 996,094 A * 6/1911 Keogh ..... 205/372
3,681,229 A * 8/1972 Lowe ..... 204/245
4,172,018 A * 10/1979 Moix et al. ..... 205/392
5,476,574 A * 12/1995 Welch et al. ..... 205/392
6,221,233 B1 * 4/2001 Rendall ..... 205/372

* cited by examiner

*Primary Examiner*—Nam Nguyen
*Assistant Examiner*—Brian L. Mutschler
(74) *Attorney, Agent, or Firm*—Jaydeep R. Deshmukh

(57) ABSTRACT

An electrolytic cell (40) for the electrowinning of aluminium comprises a plurality of anodes (60) immersed in a molten electrolyte (50), each anode (60) having an oxygen-evolving active surface of open structure facing and spaced by an inter-electrode gap from a cathode (70); a thermal insulating cover (45) above the surface (51) of the molten electrolyte (50); and an alumina feed device (10) arranged above the molten electrolyte surface (51) for spraying and/or blowing alumina (55) to an area of the molten electrolyte surface (51), from where the alumina (55) dissolves as it enters the electrolyte (50) and alumina-rich electrolyte flows to the inter-electrode gaps where it is electrolysed to produce oxygen gas on the anodes (60) and aluminium on the cathode (70).

26 Claims, 4 Drawing Sheets

METHOD FOR PRODUCING ALUMINUM AND ELECTROLYTIC CELL WITH IMPROVED ALUMINA FEED DEVICE

This application is a continuation-in-part of PCT/IB00/0477 Apr. 17, 2000 and is a continuation-in-part of PCT/IB99/00697 Apr. 16, 1999.

FIELD OF THE INVENTION

The present invention relates to a cell for the electrowinning of aluminium from alumina dissolved in a fluoride-containing molten electrolyte, fitted with an alumina feed device for feeding alumina over substantially the entire surface of the molten electrolyte; an alumina feed device for such a cell; and a method for producing aluminium in such a cell.

BACKGROUND OF THE INVENTION

The technology for the production of aluminium by the electrolysis of alumina, dissolved in molten cryolite containing salts, at temperatures around 950° C. is more than one hundred years old. This process, conceived almost simultaneously by Hall and Héroult, has not evolved as much as other electrochemical processes, despite the tremendous growth in the total production of aluminium that in fifty years has increased almost one hundred fold. The process and the cell design have not undergone any great change or improvement and carbonaceous materials are still used as electrodes and cell linings.

An important aspect of the production of aluminium in such cells resides in the way in which alumina is fed to the molten electrolyte for its subsequent dissolution and electrolysis, as described hereafter.

Conventional cells are usually operated with a crust of frozen electrolyte above the molten electrolyte. This crust needs to be periodically broken to form an opening for feeding alumina into the molten electrolyte situated underneath. Various systems have been provided to locally break the frozen electrolyte crust and feed alumina into the molten electrolyte, for instance as described in U.S. Pat. Nos. 3,664,946 (Schaper/Springer/Kyburz), 4,049,529 (Golla), 4,437,964 (Gerphagnon/Wolter), 5,045,168 (Dalen/Kvalavag/Nagell), 5,108,557 (Nordquist), 5,294,318 (Grant/Kristoff), 5,324,408 and 5,423,968 (both in the name of Kissane).

One drawback of feeding alumina to the molten electrolyte by initially breaking the electrolyte crust resides in the introduction of a mass of frozen electrolyte into the molten electrolyte which generates a thermal shock therein. Moreover, after the crust is broken cold alumina is added to the molten electrolyte which inevitably freezes the bath, thereby forming dense alumina and/or electrolyte aggregates increasing the chance of sludging.

Therefore, with the trend towards more automated systems, the frequency of feeding alumina has been increased. Feeding may take place every 20 to 90 min., sometimes even shorter, for instance every 1 to 5 min. as described in U.S. Pat. No. 3,673,075 (Kibby), while smaller amounts of alumina are introduced with each feed. The advantages are in particular maintaining a more constant concentration of dissolved alumina in the electrolyte and reducing the temperature variation in the electrolyte. A typical automated break and feed system comprises a pneumatically-operated crust breaker beam and an ore bin capable of discharging a fixed amount of alumina (K. Grjotheim & B. J. Welsh, "Aluminium: Smelter Technology ", 1988, 2nd Edition, Aluminium Verlag GmbH, D-4000 Düsseldorf 1, pp. 231–232).

U.S. Pat. No. 5,476,574 (Welsh/Stretch/Purdie) discloses a feeder arranged to continuously feed alumina to an aluminium electrowinning cell. The feeder is associated with a point breaker which is operated to maintain a hole in a frozen electrolyte crust on the surface of the molten electrolyte.

In order to enhance dispersion, dissolution and control of the amount of fine particulate alumina fed to the electrolytic bath, various alumina feed devices have been developed involving fluidisation of alumina powder by using compressed gas such as compressed air, for instance as disclosed in U.S. Pat. Nos. 3,901,787 (Niizeki/Watanabe/Yamamoto/Takeuchi/Kubota), 4,498,818 (Gudmundur/Eggertsson) and 4,525,105 (Jaggi).

Although substantial efforts have been made to enhance the feeding of alumina as described above, such feeding is still locally limited to one or more feeding points over the electrolytic bath between dipping carbon anode blocks. Furthermore, the above described processes still necessitate to periodically form or continuously maintain as many holes into the frozen electrolyte crust above the molten bath as there are feeding points.

OBJECTS OF THE INVENTION

It is an object of the invention to provide a cell for the electrowinning of aluminium fitted with an alumina feed device designed to feed alumina to substantially the entire anode's surface.

A further object of the invention to provide a cell for the electrowinning of aluminium fitted with an alumina feed device designed to operate with a substantially crustless molten electrolyte.

Another object of the invention is to provide a cell for the electrowinning of aluminium fitted with an alumina feed device designed to feed and disperse pre-heated alumina powder to the molten electrolyte to minimise the risk of sludging and enhance dissolution of the fed alumina.

Yet another object of the invention is to provide a cell for the electrowinning of aluminium fitted with an alumina feed device designed to feed continuously or intermittently alumina to the molten electrolyte.

A still further object of the invention is to provide an alumina feed device for such aluminium electrowinning cells as well as a method to produce aluminium in such cells.

SUMMARY OF THE INVENTION

The invention relates to an electrolytic cell for the electrowinning of aluminium from alumina dissolved in a fluoride-containing molten electrolyte. The cell comprises a plurality of anodes immersed in the molten electrolyte, each anode having an oxygen-evolving active surface of open structure facing and spaced by an inter-electrode gap from a cathode; a thermal insulating cover above the molten electrolyte surface; and an alumina feed device arranged above the molten electrolyte surface for supplying alumina to the molten electrolyte surface from where the alumina is dissolved as it enters the electrolyte to enrich the electrolyte in dissolved alumina. Alumina-containing electrolyte is electrolysed in the inter-electrode gaps to produce oxygen gas on the anodes an aluminium on the cathode.

The alumina feed device comprises means for spraying and/or blowing alumina between the molten electrolyte surface and the thermal insulating cover and over an entire expanse of the surface of the electrolyte, hereinafter called the "alumina feeding area", so that upon dissolution of alumina sprayed and/or blown to the electrolyte, electrolyte enriched in dissolved alumina flows to the inter-electrode gaps where is electrolysed.

In other words, the anode feeding area is at least a portion of the surface of the electrolyte whose size is substantially greater than that with conventional point feeders. Thus, alumina powder fed with this feeder is spread over a substantially greater surface of molten electrolyte and can much easier dissolve. The size of the expanse may be at least a tenth or a fifth of the surface area of the anode structure, in particular from a quarter to a half of the full surface area. Typically, the expanse may have a size of at least 0.1 $m^2$, such as 0.5 or 1 or 2 $m^2$ to 6 or 10 $m^2$ or more.

Conveniently, the spraying and/or blowing means are arranged to spray and/or blow alumina into an area which corresponds approximately to the perpendicular projection on the surface of the molten electrolyte of the active anode surface. For example, a spraying and/or blowing means may be arranged to spray and/or blow alumina over an expanse which covers entirely or at least partly the perpendicular projection onto the molten electrolyte surface of an active anode surface. The alumina feeding area may correspond to the feeding area of one anode or several anodes.

In one embodiment, the anode feeding area corresponds to a projection onto the surface of the electrolyte of the active anode surfaces, this projection possibly being smaller or greater than the corresponding area(s) of the active anode surfaces. This anode feeding area is usually, but not necessarily, situated above the active anode surfaces.

The alumina feeding area typically occupies an expanse of the molten electrolyte surface which can be about the same size as the surface area of the corresponding active anode surfaces. However, when anodes co-operate with special electrolyte circulation means, for instance as disclosed in co-pending application PCT/IB00/00027 (de Nora), the size of the feeding area may be smaller than the actual size of the active anode surfaces. In practice, powder alumina may even be supplied over substantially the entire surface of the molten electrolyte.

This is particularly advantageous in configurations where at least part of the alumina-rich electrolyte flows through the open anode structures to the inter-electrode gap. At least part of the alumina-rich electrolyte may flow around the open anode structures into the inter-electrode gap to be electrolysed and then alumina-depleted electrolyte can rise to the feeding area through the open anode structures.

Whether or not alumina flows around the anodes, alumina dissolution is improved with such an alumina feeding device. The improvement is not bound to a specific electrolyte circulation path. Either alumina-rich electrolyte flows from the feeding area down through the anode structure, or alumina-depleted electrolyte flows through the anode structure up to the feeding area, or both flow patterns are combined.

Although the concept of this invention may be adapted to any aluminium electrowinning cell, it is specially designed for cells operating with metal-based anodes at reduced temperatures, typically below 910° C., such as in the range of 730° to 870° C. or 750° to 850° C., in particular cells as disclosed in co-pending applications PCT/IB00/00029 and PCT/IB00/00027 (both in the name of de Nora) operating with metal-based oxygen-evolving grid-like anodes provided with vertical through openings for the circulation of electrolyte and the escape of anodically produced oxygen.

Suitable materials for oxygen-evolving anodes include iron and nickel based alloys which may be heat-treated in an oxidising atmosphere as disclosed in WO00/06802, WO00/06803 (both in the name of Duruz/de Nora/Crottaz), WO00/06804 (Crottaz/Duruz), PCT/IB99/01976 (Duruz/de Nora) and PCT/IB99/01977 (de Nora/Duruz). Further oxygen-evolving anode materials are disclosed in WO99/36593, WO99/36594, WO00/06801, WO00/06805, PCT/IB00/00028 (all in the name of de Nora/Duruz), WO00/06800 (Duruz/de Nora), WO99/36591 and WO99/36592 (both in the name of de Nora).

The thermal insulating cover is normally arranged to inhibit formation of an electrolyte crust on the surface of the molten electrolyte during operation. However, the surface of the electrolyte does not need to be entirely crust free, but at least the feeding area should be free from any frozen electrolyte crust for optimal operation.

Also, to overcome a prior art prejudice as described above, it is preferred to supply preheated alumina to the molten electrolyte to minimise electrolyte freezing caused by contact with "cold" solid alumina and by the endothermic alumina dissolution reaction in the molten electrolyte. Ideally the fed alumina supplies at least part of the energy needed for its dissolution. Heat may be provided to the alumina during the feeding process by contact with hot air, by using a heater or possibly with a burner providing a flame which may also be used to spray and/or blow alumina powder. The alumina may be preheated before feeding, for instance by heating an alumina reservoir in which it is stored and from which it is fed to the molten electrolyte by spraying and/or blowing according to the invention. More generally, the alumina may be heated before and/or during spraying and/or blowing.

The alumina feed device may be fitted with a blower or a fan for spraying or blowing alumina with gas, e.g. air.

Bayer-process alumina or other suitable grades of alumina, may be utilised. For instance, partly dehydrated alumina particles, modified alumina, and alumina particles of different shapes and sizes may be used.

To enhance dispersion of the alumina powder above the molten electrolyte surface, and to facilitate its dissolution into the molten electrolyte, the alumina powder is preferably composed of particles in the range of 20 to 200 micron, preferably from 30 to 50 micron.

In one embodiment of the invention, the alumina feed device comprises nozzles for spraying alumina. Usually, a plurality of nozzles are distributed along at least one generally horizontal alumina feeding pipe that is arranged to carry alumina from an alumina reservoir to the nozzles. The nozzles may be placed in a generally horizontal sideways arrangement along the feeding pipe so as to generate a horizontal dispersion of sprayed alumina, to spray alumina powder over substantially the entire molten electrolyte surface.

The alumina feed device may comprise a blower or a fan, for spraying alumina from the nozzles with compressed gas, preferably hot gas, in particular hot air. The alumina may be preheated by using a radiator as described above.

In another embodiment, the alumina feed device may comprise an alumina reservoir for feeding alumina onto a spreader from which during operation alumina is sprayed and/or blown, for instance, such spreader may be a rotary spreader which rotates so as to spray the alumina by centrifugal force. The rotary spreader may comprise a substantially horizontal planar spreading surface, for instance substantially circular, and arranged to rotate in its own plane.

Such spreaders may co-operate with a fan and/or a blower to blow alumina from the spreader with gas or a flame.

The invention relates also to an alumina feed device for feeding alumina to the surface of a fluoride-containing molten electrolyte of a cell for the electrowinning of aluminium from alumina dissolved in the molten electrolyte, in particular a cell comprising a thermal insulation above the surface of the molten electrolyte.

According to the invention, the alumina feed device comprises means for spraying and/or blowing alumina powder over an entire expanse of the surface of the molten electrolyte, as described above. Usually, the spraying and/or blowing means is arranged to spray and/or blow alumina sidewards, for example nozzles arranged substantially horizontally or a substantially horizontal alumina spreader as described above.

As opposed to conventional point feeders which feed alumina only to one point of the electrolyte surface, the alumina feeding device according to the invention is arranged to feed alumina powder over an entire expanse of the molten electrolyte surface which enhances the dissolution of fed alumina.

Furthermore, there is no need to remove the spraying and/or blowing means from under the insulating cover or possibly the crust of molten electrolyte. Normally the means is permanently located under the cover or the crust which can remain sealed off while alumina is fed to the molten electrolyte to avoid thermic losses. Conversely, conventional feeders are located above the crust of molten electrolyte, the crust being periodically broken to permit alumina feeding from above the crust into the molten electrolyte.

Another aspect of the invention is a method of producing aluminium in a cell as described above. The method comprises spraying and/or blowing alumina from the alumina feed device over an entire expanse of the surface of the molten electrolyte from where the alumina dissolves as it enters the electrolyte to enrich the electrolyte in dissolved alumina, feeding the electrolyte enriched with alumina to the inter-electrode gaps and electrolysing the electrolyte enriched with alumina in the inter-electrode gaps to produce oxygen on the active anode surfaces and aluminium on a facing cathode.

A further aspect of the invention is an electrolytic cell for the electrowinning of aluminium from alumina dissolved in a fluoride-containing molten electrolyte. The cell comprises one or more anodes immersed in a molten electrolyte, each anode having an oxygen-evolving active surface of open structure facing and spaced by an inter-electrode gap from a cathode; a thermal insulation above the molten electrolyte surface; and means for supplying alumina powder to the molten electrolyte surface from where the alumina is dissolved as it enters the electrolyte to enrich the electrolyte in dissolved alumina. Alumina-containing electrolyte is electrolysed in the inter-electrode gaps to produce oxygen gas on the anodes and aluminium on the cathode.

The means for supplying alumina powder is located above the molten electrolyte surface and extends through the thermal insulation. For instance, the alumina supply means comprises an alumina distribution head or nozzle or the like that extends through the thermal insulation. The alumina supply means is arranged for supplying alumina powder over an area of the surface of the electrolyte so that upon dissolution of alumina supplied to the electrolyte, electrolyte enriched in dissolved alumina flows down to the inter-electrode gaps where it is electrolysed. At least part of the electrolyte enriched in dissolved alumina flows down through the open anode structures to the inter-electrode gaps and/or alumina depleted electrolyte flows up from the inter-electrode gaps through the open anode structures.

Thus the openings in the anode structure are used for the down and/or up flow of electrolyte from and/or to the alumina feeding area.

Usually, the thermal insulation above the molten electrolyte consists of a cover which is placed and spaced above the surface of the molten electrolyte, for instance as disclosed in co-pending patent application WO99/02763 (de Nora/Sekhar). Such cover thermally insulates the surface of the molten electrolyte and substantially prevents formation of an electrolyte crust on the molten electrolyte. The thermally insulated cavity thereby created between the molten electrolyte and the cover serves to house the alumina supply means, in particular the spraying and/or blowing means, of the alumina feed device.

Alternatively, if the cell is operated at a conventional temperature (i.e. around 950° C.) the thermal insulation can also include an electrolyte crust, formed by electrolyte freezing, but which is sufficiently spaced from the molten electrolyte to permit the insertion of the alumina supply means, in particular the spraying and/or blowing means, between the molten electrolyte and the crust, the molten electrolyte level being maintained at a sufficiently low level below the crust. However, cells operated at reduced temperatures (i.e. typically between 730° and 870° C. or between 750°and 850° C.) should have an insulating cover above the molten electrolyte, since at such temperatures, the molten electrolyte does not usually form a rigid crust but a gel-like layer.

DETAILED DESCRIPTION

Figure 1:
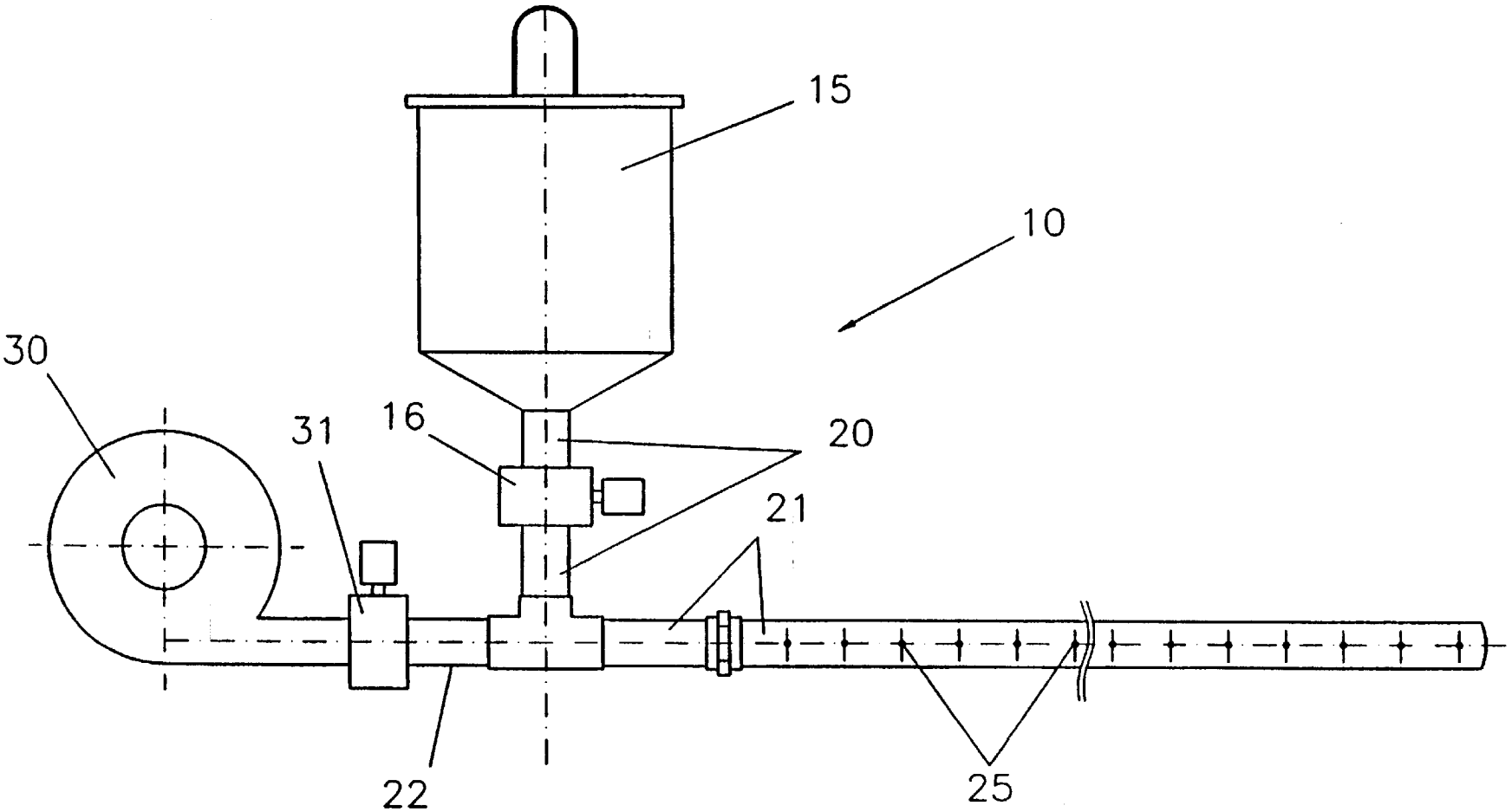
FIG. 1 is a side elevation view of an alumina feed device provided with a series of nozzles for spraying alumina powder according to the invention.

FIG. 1 shows an alumina feed device 10 according to the invention. The alumina feed device 10 is provided with an alumina reservoir 15 connected to the upper end of a vertical alumina supply pipe 20. The lower end of the alumina supply pipe 20 is connected to an alumina feeding pipe 21 which is provided with a series of alumina feeding nozzles 25 for spraying under pressure alumina powder to a molten electrolyte situated underneath (not shown).

The alumina feeding pipe 21 is also connected to a compressed hot gas source 30 such as a fan or blower, through a gas pipe 22 for carrying a flow of gas from the fan/blower 30 to the feeding pipe 21.

An alumina gate 16 located on the alumina supply pipe 20 controls the supply of alumina from the alumina reservoir 15 through the supply pipe 20 to the feeding pipe 21. A gas gate 31 is located on the gas pipe 22 for controlling the flow of gas from the fan/blower 30 to the feeding pipe 21 through the gas pipe 22.

During operation, alumina powder is supplied from the alumina reservoir 15 through the supply pipe 20 to the feeding pipe 21 and gas is injected from the fan/blower 30 through the gas pipe 22 to the feeding pipe 21. The gas carries the alumina powder along the feeding pipe 21 for its spraying through the nozzles 25 onto a molten electrolyte located therebelow.

Figure 2:
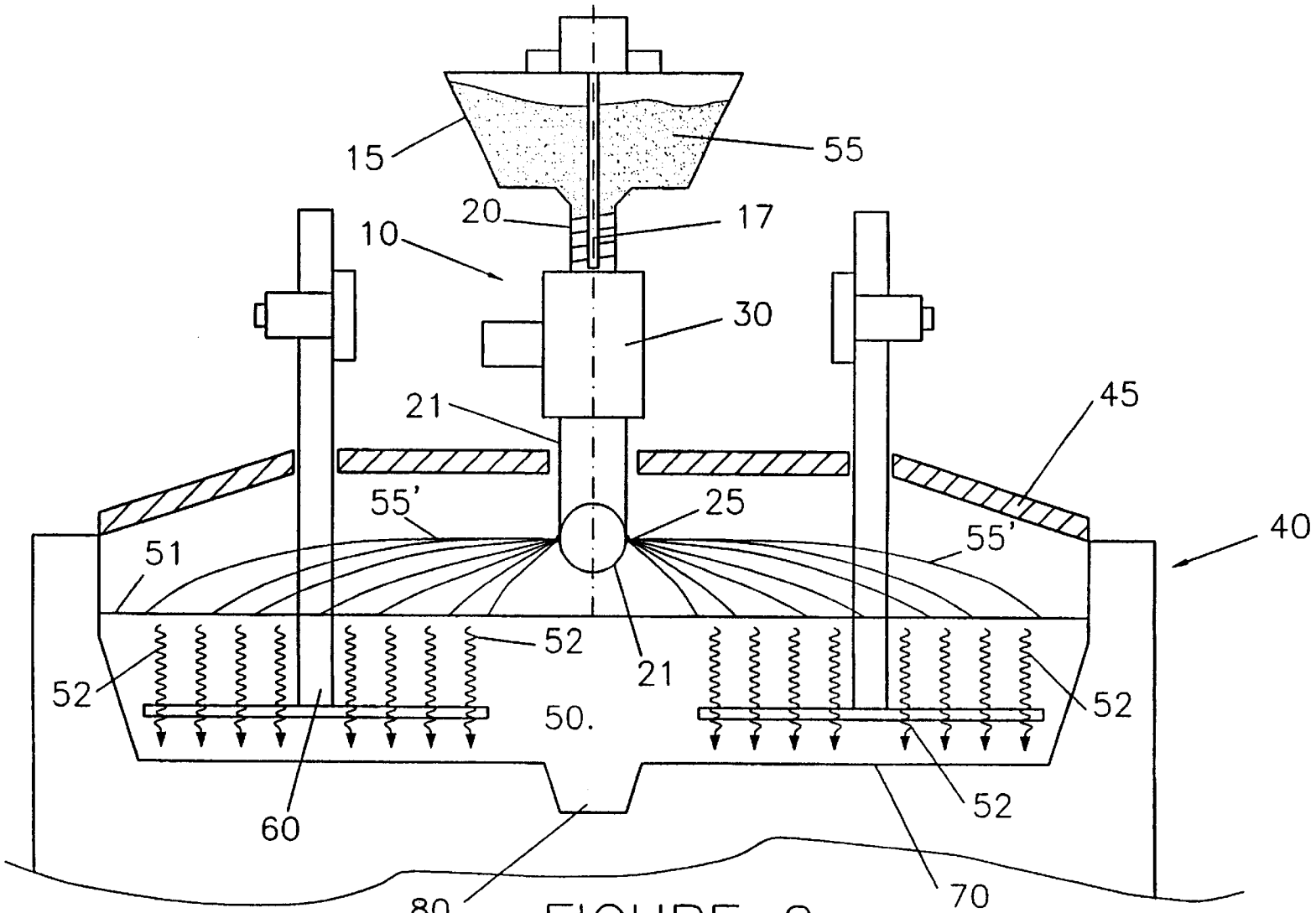
FIG. 2 illustrates an aluminium electrowinning cell which is provided according to the invention with an alumina feed device which is similar to the feed device shown in FIG. 1.

FIG. 2 illustrates an aluminium electrowinning cell 40 provided with oxygen-evolving anodes 60 immersed in a molten fluoride-containing electrolyte 50 at 730° to 960° C. The anodes 60 face and are spaced apart from an aluminium wettable drained cathode surface 70 by an anode-cathode gap. The drained cathode surface 70 leads into an aluminium collection groove 80 for the collection of produced molten aluminium. The cathode surface 70 is preferably coated with a slurry-applied aluminium-wettable layer, for instance as disclosed in PCT/IB99/01982 (de Nora/Duruz) or U.S. Pat. No. 5,651,874 (de Nora/Sekhar).

The anodes 60 comprise a series of vertical through openings for the fast release of anodically produced oxygen and for the down flow of alumina-rich electrolyte 52 into the anode-cathode gap for electrolysis, for example as described in co-pending applications PCT/IB00/00029 and PCT/IB00/00027 (both in the name of de Nora).

As disclosed in these two applications, suitable anodes may have a horizontal, inclined or possibly vertical foraminate active anode structure. The active anode structure may be made of a series of generally parallel spaced-apart coplanar electrochemically active anode members, in particular a grid-like, net-like or mesh-like arrangement, permitting electrolyte circulation there-through. Advantageously, the active anode structure cooperates with electrolyte guide members promoting electrolyte circulation, in particular the circulation of alumina-rich electrolyte through the active anode structure to the inter-electrode gap and/or alumina-depleted electrolyte from the inter-electrode gap towards the molten electrolyte surface. The electrolyte guide members may be made of suitably inclined baffles or a funnel-like device.

According to a preferred embodiment of the invention, the cell 40 is covered with an insulating cover 45 for maintaining the surface 51 of the electrolyte 50 at a sufficient temperature to inhibit formation of a crust thereon, for instance as disclosed in co-pending patent application WO99/02763 (de Nora/Sekhar).

The cell 40 is further provided with an alumina feed device 10 having a vertical Archimedes, screw 17 instead of the alumina gate 16 shown in FIG. 1 for dosing alumina powder 55 to be fed from the alumina reservoir 15 to the surface 51 of the molten electrolyte 50.

The feed device 10 further comprises as shown in FIG. 2 a fan/blower 30, a supply pipe 20 and a gas pipe like in FIG. 1 but which is hidden by the fan/blower 30, all located above the insulating cover 45. A feeding pipe 21 connected to the supply pipe 20 and to the gas pipe extends through the insulating cover 45 so that a series of alumina feeding nozzles 25 situated laterally along the feeding pipe 21 is located above the molten surface 51 of the electrolyte 50 and below the insulating cover 45.

During operation of the cell shown in FIG. 2, an amount of alumina powder 55 is intermittently or continuously dosed through the supply pipe 20 into the feeding pipe 21 by driving the vertical Archimedes' screw 17. Simultaneously or subsequently, hot gas is injected from the fan/blower 30 through the gas pipe to the feeding pipe 21. The injected gas carries the alumina powder 55 along the feeding pipe 21. Subsequently a mixture 55' of gas and alumina powder 55 dispersed therein is sprayed under pressure through the nozzles 25 to the surface 51 of the molten electrolyte 50 above the oxygen evolving anodes 60 where it is dissolved.

The alumina-rich electrolyte 52 flows down the through-openings of the anodes 60 to the gap between the anodes 60 and the cathode surface 70 where it is electrolysed to produce oxygen on the anodes 60 and molten aluminium on the cathode surface 70. The produced molten aluminium is evacuated from the cathode surface 70 into the aluminium collection groove 80. The alumina-depleted electrolyte resulting from electrolysis is driven up by anodically released oxygen (not shown) from under and through the anodes 60 towards the molten electrolyte surface 51 where it is enriched with dissolving alumina.

Figure 3:
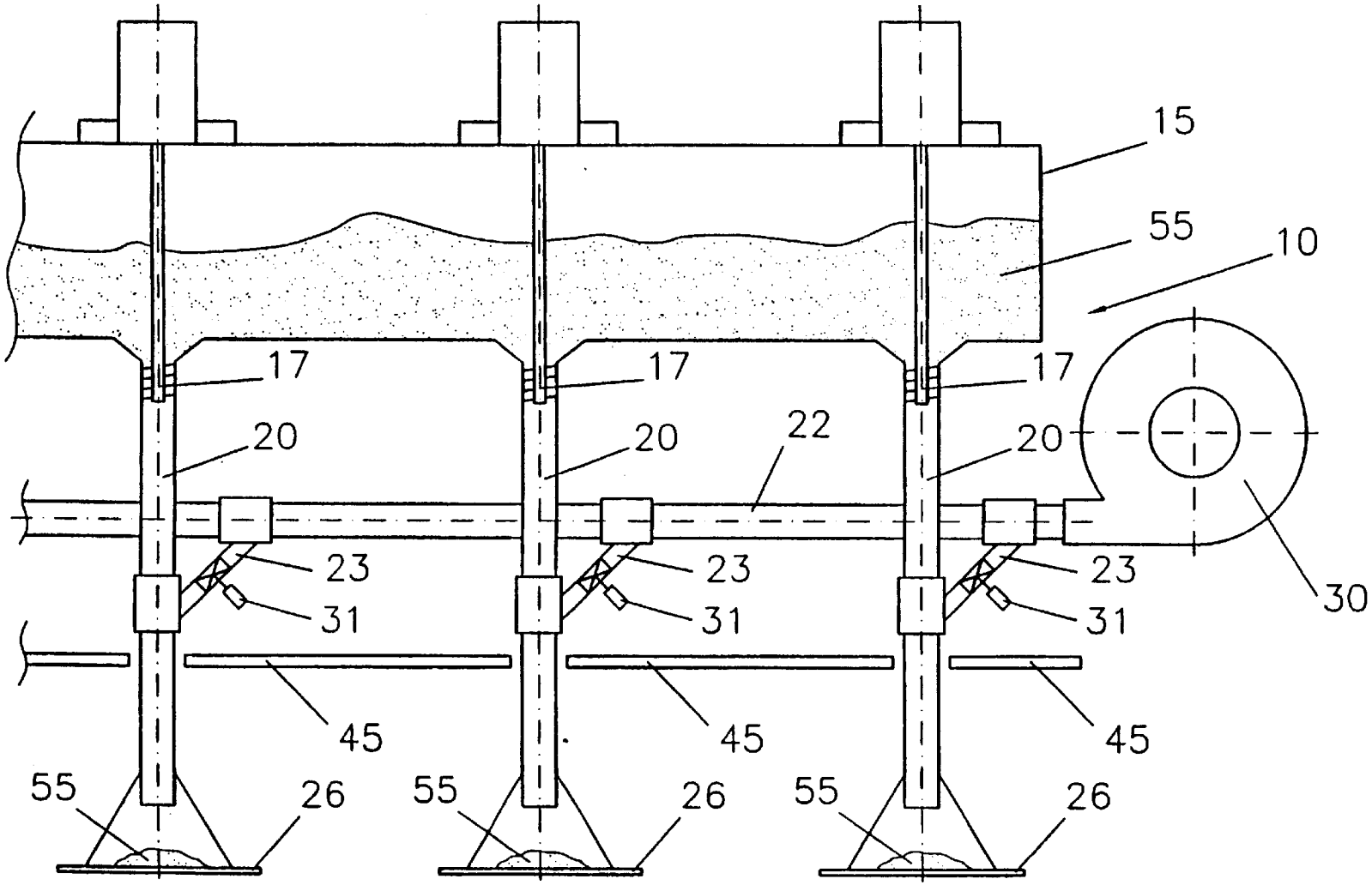
FIG. 3 shows another alumina feed device provided with a horizontal planar spreading surface according to the invention fitted on an aluminium electrowinning cell of which only the cover is shown.

FIG. 3 shows an alumina feed device 10 fitted on an aluminium electrowinning cell (partly shown) provided with a thermal insulating cover 45 enabling cell operation with a molten electrolyte surface which is substantially crustless (as shown in FIG. 2).

The alumina feed device 10 comprises an alumina reservoir 15 whose bottom leads to a series of vertical alumina supply pipes 20. The vertical alumina supply pipes 20 extend from the alumina reservoir 15 to below the insulating cover 45. Dosage of alumina powder 55 from the reservoir 15 to each supply pipe 20 is controlled with a schematically-indicated vertical Archimedes' screw 17 which is located at the entrance of each supply pipe 20.

Under the lower end of each alumina supply pipe 20 is suspended an alumina spreader 26 above the surface of a molten electrolyte (not shown). Each alumina spreader 26 is provided with a substantially planar spreading surface form which alumina powder 55 can be sprayed.

Each alumina supply pipe 20 is also connected to a source of a hot gas 30 arranged to spray or blow alumina powder 55 from the alumina spreader 26 to the molten electrolyte surface.

For this purpose, similarly to the feed devices 10 shown in FIGS. 1 and 2, a fan/blower 30 is connected through a gas pipe 22 and a series of deviation pipes 23 to the supply pipes 20. Each deviation pipe 23 is provided with a gas gate 31 controlling the flow of gas from the gas pipe 22 to the alumina supply pipe 20 and subsequently onto the alumina spreader 26.

During cell operation, alumina powder 55 is periodically or continuously fed from the alumina reservoir 15 to the alumina spreader 26 by driving the Archimedes' screws 17. Cold or preferably hot gas is provided from the fan/blower 30 through the gas pipe 22, the deviation pipes 31 and the alumina supply pipes 20 vertically down onto the alumina spreaders 26 by opening the gas gates 31. Powder alumina 55 accumulated on the alumina spreaders 26 is periodically sprayed or blown away therefrom over the surface of the molten electrolyte by the gas or flame. Alternatively, the powder alumina 55 may be continuously sprayed or blown away from the spreaders 26, preventing accumulation of alumina 55 thereon.

Figure 4:
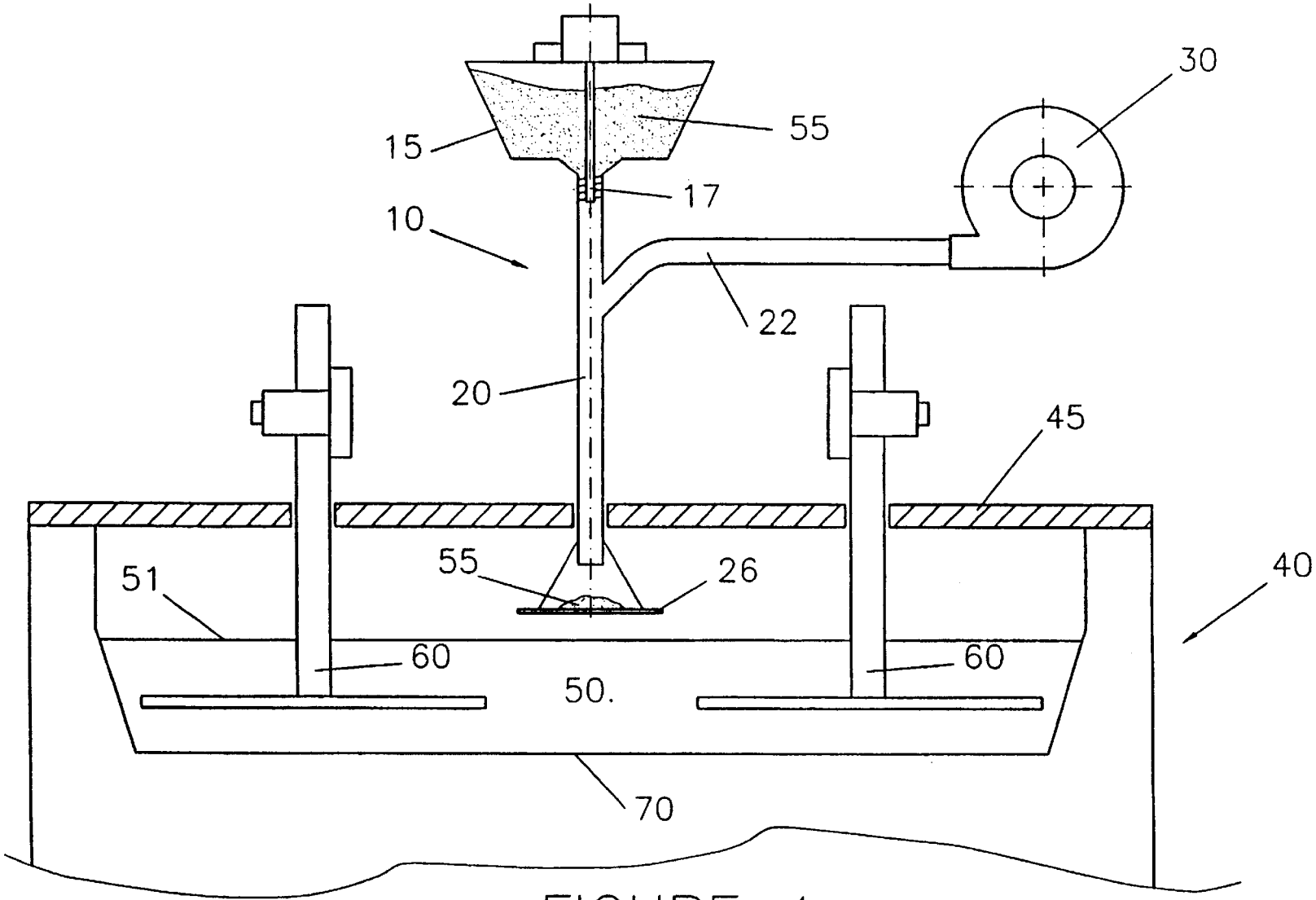
FIG. 4 shows a cross-section of a cell provided with an alumina feed device which is similar to the feed device shown in FIG. 3.

FIG. 4 shows a vertical cross section of part of a cell 40 similar to the cell partly shown in FIG. 3, however, provided with a modified alumina feed device 10.

Like in FIG. 3, the alumina feed device shown in FIG. 4 comprises an alumina reservoir 15 for containing alumina powder 55, Archimedes' screws 17 for intermittently or continuously dosing an amount of alumina powder 55 to be fed via supply pipes 20 to alumina spreaders 26 from where it is sprayed or blown away by cold or preferably hot gas. In contrast to the alumina feed device 10 shown in FIG. 3 provided with a single fan/blower 30, each supply pipe 20 of FIG. 4 is fitted with an individual fan/blower 30 which is directly connected thereto through a gas pipe 22.

The anodes 60 shown in FIG. 4 are similar to the oxygen evolving anodes shown in FIG. 2 and face a cathode surface 70 on which during operation aluminium is produced.

The cell 40 shown in FIG. 4 may either be operated with a deep or shallow cathodic pool of molten aluminium above the cathode surface 70, or in a drained configuration by having an aluminium-wettable drained cathode surface 70 as described above.

What is claimed is:

1. An electrolytic cell for electrowinning of aluminium from alumina dissolved in a fluoride-containing molten electrolyte, the cell comprising a plurality of anodes immersed in a molten electrolyte, each anode having an oxygen-evolving active surface of open structure facing and spaced by an inter-electrode gap from a cathode; a thermal insulating cover above the molten electrolyte surface; and an alumina feed device arranged above the molten electrolyte surface for supplying alumina to the molten electrolyte surface from where the alumina is dissolved as it enters the electrolyte to enrich the electrolyte in dissolved alumina, alumina-containing electrolyte being electrolysed in the inter-electrode gaps to produce oxygen gas on the anodes and aluminium on the cathode, wherein the alumina feed device comprises means for spraying and/or blowing alumina sidewards between the molten electrolyte surface and the thermal insulating cover and over an entire expanse of the surface of the molten electrolyte, so that upon dissolution of alumina sprayed and/or blown to the electrolyte, electrolyte enriched in dissolved alumina flows down to the inter-electrode gaps.

2. The electrolytic cell of claim 1, wherein at least part of the electrolyte enriched in dissolved alumina flows down through the open anode structures to the inter-electrode gaps.

3. The electrolytic cell of claim 1, wherein alumina depleted electrolyte flows up from the inter-electrode gaps through the open anode structures.

4. The electrolytic cell of claim 1, wherein the spraying and/or blowing means is arranged to spray and/or blow alumina over an expanse which covers at least part of an area on the molten electrolyte surface of an active anode surface.

5. The electrolytic cell of claim 4, wherein the spraying and/or blowing means is arranged to spray and/or blow alumina into an area which corresponds approximately to an area on the molten electrolyte surface above the active anode surface.

6. The electrolytic cell of claim 4, wherein the alumina feed device is arranged to feed alumina powder over substantially the entire molten electrolyte surface.

7. The electrolytic cell of claim 1, wherein the alumina feed device comprises nozzles for spraying alumina.

8. The electrolytic cell of claim 7, wherein the alumina feed device comprises a plurality of nozzles which are distributed along at least one alumina feeding pipe.

9. The electrolytic cell of claim 1, wherein the alumina feed device comprises a fan or a blower for spraying alumina.

10. The electrolytic cell of claim 1, wherein the alumina feed device comprises an alumina reservoir for feeding alumina onto a spreader from which alumina is sprayed and/or blown.

11. The electrolytic cell of claim 10, wherein the spreader is a rotary spreader which rotates so as to spray the alumina by centrifugal force.

12. The electrolytic cell of claim 11, wherein the rotary spreader comprises a substantially horizontal planar spreading surface arranged to rotate in its own plane.

13. The electrolytic cell of claim 12, wherein the spreading surface is substantially circular.

14. The electrolytic cell of claim 1, wherein the alumina feed device comprises a heater arranged to heat alumina before and/or during spraying and/or blowing.

15. A method of producing aluminium in a cell as defined in claim 1, comprising spraying and/or blowing alumina sidewards from the alumina feed device over the surface of the molten electrolyte from where the alumina dissolves as it enters the electrolyte to enrich the electrolyte in dissolved alumina, feeding the electrolyte enriched with alumina to the inter-electrode gaps, and electrolysing the electrolyte enriched with alumina in the inter-electrode gaps to produce aluminium on at least one cathode and oxygen gas on facing anodes.

16. The method of claim 15, comprising spraying and/or blowing alumina particles, the sizes of which are in the range of 20 to 200 microns.

17. The method of claim 16, comprising spraying and/or blowing alumina particles, the sizes of which are in the range of 30 to 50 microns.

18. An alumina feed device for feeding alumina to a surface of a fluoride-containing molten electrolyte in a cell for electrowinning aluminium from alumina dissolved in the molten electrolyte, the cell comprising a thermal insulating cover above the molten electrolyte surface, said alumina feed device comprising means for spraying and/or blowing alumina powder sidewards over an entire expanse of the surface of the molten electrolyte.

19. The alumina feed device of claim 18, comprising nozzles for spraying alumina.

20. The alumina feed device of claim 19, wherein a plurality of nozzles are distributed along at least one alumina feeding pipe.

21. The alumina feed device of claim 18, wherein the alumina feeding pipe is associated with a fan or a blower for spraying alumina.

22. The alumina feed device of claim 18, comprising an alumina reservoir for feeding alumina onto a spreader from which during operation alumina is sprayed and/or blown.

23. The alumina feed device of claim 22, wherein the spreader is a rotary spreader which rotates so as to spray the alumina by centrifugal force.

24. The alumina feed device of claim 23, wherein the rotary spreader comprises a substantially horizontal planar spreading surface arranged to rotate in its own plane.

25. The alumina feed device of claim 24, wherein the spreading surface is substantially circular.

26. The alumina feed device of claim 18, comprising a heater arranged to heat alumina before and/or during spraying and/or blowing.

* * * * *